US010343825B2

(12) United States Patent
Baumann

(10) Patent No.: US 10,343,825 B2
(45) Date of Patent: Jul. 9, 2019

(54) DISCHARGE HEAD AND DISPENSER WITH SUCH A DISCHARGE HEAD

(71) Applicant: Tobias Baumann, Constance (DE)

(72) Inventor: Tobias Baumann, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 57 days.

(21) Appl. No.: 15/336,211

(22) Filed: Oct. 27, 2016

(65) Prior Publication Data

US 2017/0121070 A1 May 4, 2017

(30) Foreign Application Priority Data

Oct. 28, 2015 (EP) ..... 15191981

(51) Int. Cl.
*B65D 47/20* (2006.01)
*B05B 11/00* (2006.01)
(Continued)

(52) U.S. Cl.
CPC ..... *B65D 47/2068* (2013.01); *A45D 40/0075* (2013.01); *A45D 40/24* (2013.01);
(Continued)

(58) Field of Classification Search
CPC ..... A45D 40/0075; A45D 40/24; B65D 47/2068; B65D 83/0055; B05B 9/0838;
(Continued)

(56) References Cited

U.S. PATENT DOCUMENTS 4,057,176 A * 11/1977 Horvath ..... B05B 11/0027 222/175
4,927,059 A 5/1990 Fiedler et al.
(Continued)

FOREIGN PATENT DOCUMENTS

DE 88 14 636.7 U1 5/1989
DE 10 2010 013 329 A1 2/2012
(Continued)

OTHER PUBLICATIONS

Search Report of European Patent Office issued in Application No. 15191981 with English translation of category of cited documents dated May 11, 2016 (6 pages).

*Primary Examiner* — Paul R Durand
*Assistant Examiner* — Andrew P Bainbridge
(74) *Attorney, Agent, or Firm* — Flynn Thiel, P.C.

(57) ABSTRACT

A discharge head for mixing two media and discharging the mixed liquid, having a dosing chamber, a first inlet, a second inlet, and an outlet through which the mixed liquid is discharged from the dosing chamber. A displacer is movable in an actuation direction between first and second end positions to force the mixed liquid through the outlet. A volume-compensating mechanism has a wall portion which is deflectable between a minimal position in which the volume of the dosing chamber is not enlarged and a maximal position in which the volume of the dosing chamber is enlarged to a maximum extent. Deflection of the wall portion in the direction of the maximal position enables an auxiliary volume to be made available in the dosing chamber through which, with the dosing chamber already filled with the first media, the second media can be introduced into the dosing chamber.

20 Claims, 2 Drawing Sheets

(51) Int. Cl.

| | |
|---|---|
| ***A45D 40/00*** | (2006.01) |
| ***A45D 40/24*** | (2006.01) |
| ***B65D 83/00*** | (2006.01) |
| ***B05B 9/08*** | (2006.01) |
| ***B05B 12/14*** | (2006.01) |

(52) U.S. Cl.
CPC ..... *B05B 9/0838* (2013.01); *B05B 11/0078* (2013.01); *B05B 11/3064* (2013.01); *B05B 11/3084* (2013.01); *B05B 12/1418* (2013.01); *B65D 83/0055* (2013.01); *B05B 11/3074* (2013.01)

(58) Field of Classification Search
CPC ..... B05B 11/0078; B05B 11/3064; B05B 11/3074; B05B 11/3084; B05B 12/1418
USPC ..... 417/521; 239/304, 333; 222/129, 134, 222/137, 145.1, 145.5–145.6, 207, 209, 222/325–327, 383.1
See application file for complete search history.

(56) References Cited

U.S. PATENT DOCUMENTS 5,680,966 A * 10/1997 Johnson ..... G01F 11/082 222/209
6,213,358 B1 * 4/2001 Libit ..... B05B 11/0037 222/633
6,868,987 B2 * 3/2005 Hedington ..... A61J 1/10 222/102
7,481,334 B2 * 1/2009 Arghyris ..... B05B 11/0072 222/105
8,302,817 B2 * 11/2012 Saravis ..... B05B 11/3015 222/1
9,668,562 B2 * 6/2017 Lee ..... A45D 34/04
2003/0089738 A1 * 5/2003 Peterson ..... B05B 11/0078 222/135
2005/0115988 A1 * 6/2005 Law ..... B05B 7/0037 222/145.5
2006/0186139 A1 * 8/2006 Laidler ..... B05B 11/0027 222/207
2008/0203110 A1 * 8/2008 LaFlamme ..... B65D 81/3261 222/135
2008/0283550 A1 * 11/2008 Nighy ..... F04B 43/0736 222/1
2009/0032554 A1 * 2/2009 Laidler ..... B05B 7/0025 222/207
2010/0108779 A1 * 5/2010 Filsouf ..... B05B 11/0054 239/61
2013/0015207 A1 * 1/2013 Alvarado ..... B65D 81/3288 222/144.5
2013/0056494 A1 * 3/2013 Pires ..... G01F 11/021 222/137
2015/0352574 A1 * 12/2015 Kolb ..... B05B 11/0081 222/137

FOREIGN PATENT DOCUMENTS

DE 10 2014 216 744 A1 2/2016
FR 335.026 1/1904

* cited by examiner

DISCHARGE HEAD AND DISPENSER WITH SUCH A DISCHARGE HEAD

CROSS-REFERENCE TO RELATED APPLICATIONS

This claims priority from European Patent Application No. 15 19 1981.8, filed on Oct. 28, 2015, the disclosure of which is hereby incorporated by reference in its entirety into this application.

TECHNICAL FIELD AND PRIOR ART

The invention relates to a discharge head for mixing two starting media and for discharging the mixed liquid that is thereby generated. Such a discharge head has a dosing chamber which is delimited by dosing-chamber walls on a base of the discharge head and on a displacer. The discharge head moreover has a first inlet, through which a first of the two starting media can flow into the dosing chamber, and a second inlet, through which a second of the two starting media can flow into the dosing chamber. Moreover, the discharge head has an outlet through which the mixed liquid can be discharged from the dosing chamber.

The displacer is manually movable relative to the base in an actuation direction between a first end position and a second end position, such that, during the movement of the displacer from the first end position to the second end position, the volume of the dosing chamber is reduced and the mixed liquid is forced out through the outlet.

A discharge head of this kind can thus be used to discharge a mixture composed of two liquids. Depending on the design, it makes it possible to variably adjust the mixing ratio between the two liquids that are mixed together in the dosing chamber.

However, it is problematic when this variable adjustment is intended to be effected by an adjustable amount of the second medium being added after the dosing chamber has been filled with the first medium. The introduction of the second starting medium into the dosing chamber can lead to liquid already flowing out through the outlet of the dosing chamber.

Problem and Solution

The problem addressed by the invention is that of allowing a mixed liquid to be produced in a convenient way, without undesired escape of liquid occurring.

To this end, it is proposed that the dosing chamber has a volume-compensating mechanism. This volume-compensating mechanism has a deflectable dosing-chamber wall portion which delimits the dosing chamber and which is deflectable, with respect to the first end position of the displacer relative to the base, between a minimal position, in which it does not enlarge the volume of the dosing chamber, and a maximal position, in which it enlarges the volume of the dosing chamber to a maximum extent. By virtue of the deflection of the deflectable dosing-chamber wall portion in the direction of the maximal position, an auxiliary volume is made available in the dosing chamber through which, with the dosing chamber already filled with the first starting medium and with the displacer arranged in its first end position, the second starting medium can still be introduced into the dosing chamber.

In a discharge head according to the invention, which has a dosing chamber with a first and second inlet and an outlet and of which the dosing-chamber volume can be reduced by the movement of the displacer relative to the base, provision is accordingly made that the volume of the dosing chamber is variable independently of the relative position of the displacer with respect to the base. For this purpose, the stated volume-compensating mechanism is provided which is either arranged on the base side or the displacer side and which has the stated dosing-chamber wall portion that is deflectable relative to the base or the displacer.

This dosing-chamber wall portion can adopt the stated minimal position. If this is the case, the dosing-chamber volume is not enlarged by the deflectable dosing-chamber wall portion. Proceeding from the minimal position, it can be moved to a maximal position, in which it leads to a maximum enlargement of the dosing chamber.

In the course of use, it is thus possible firstly to fill the dosing chamber completely with the first starting medium during the return stroke of a discharge actuation, wherein the deflectable dosing-chamber wall portion of the volume-compensating mechanism is meanwhile preferably located in the minimal position. Thereafter, still before the discharge of the liquid, the second starting medium can be fed in. The dosing chamber permits this since the dosing-chamber wall portion, by moving in the direction of the maximal position, makes the necessary volume available.

In principle, the use of the discharge head according to the invention is expedient especially for media where the main volume fraction is provided by the first medium and a smaller volume fraction is provided by the second medium. This is expedient, for example, in the case of skin creams to which a small amount of self-tanning lotion is admixed.

By way of example, it is possible that the dosing chamber has a volume of between 0.2 and 1 ml when the displacer is arranged relative to the base in the first end position and when the wall portion is arranged in its minimal position, whereas the auxiliary volume achievable by movement of the dosing-chamber wall portion to the maximal position is between 0.05 and 0.3 ml. The ratio between the volume of the dosing chamber and the auxiliary volume from the volume-compensating mechanism is preferably between 3:1 and 20:1, preferably between 3:1 and 10:1.

The deflectable dosing-chamber wall portion can be formed by a dimensionally flexible wall.

The design of the deflectable dosing-chamber wall portion as a dimensionally flexible wall is relatively simple in structural terms. In such an embodiment, the wall is configured in the manner of a preferably elastic membrane. The latter can be formed by a separate structural part. It is also possible to design it integrally with surrounding wall areas of the dosing chamber, particularly if, by means of multi-component injection moulding, a material different from the surrounding walls is chosen for the membrane.

The deflectable dosing-chamber wall portion can also be formed by an inherently rigid, displaceable wall portion, in particular by a wall portion in a compensation piston which is arranged displaceably in a compensation cylinder of the dosing chamber.

The use of a rigid dosing-chamber wall portion makes it necessary that the dosing-chamber wall portion as a whole is displaceable. The stated possibility of a preferably spring-loaded compensation piston in a compensation cylinder is a particularly advantageous arrangement here, since it allows the walls of the compensation cylinder to be made transparent and, in this way, makes it possible to see the position of the dosing-chamber wall portion from the outside. In this way, for example, a user can ascertain whether he has added a sufficient amount of the second medium after the dosing chamber is filled with the first medium.

In order to introduce the first starting medium into the dosing chamber, the dosing chamber can be connected to a first reservoir for the first starting medium, wherein a valve that opens in a pressure-dependent manner is provided between the first reservoir and the dosing chamber.

As has already been stated, the first starting medium is preferably the main medium, which accounts for the main fraction of the liquid that is to be discharged. By designing the connection of the dosing chamber to the first reservoir with an interposed valve that opens in a pressure-dependent manner, it is ensured that, during the return of the displacer to its first end position (return stroke), this first starting medium is sucked in, for example from an unventilated reservoir bag or a trailing-piston reservoir or by means of a dip tube. The second starting medium can then be metered in.

In order to introduce the second starting medium into the dosing chamber, a feed mechanism can be provided that can be actuated by means of an auxiliary actuation handle.

The separate feed mechanism for the second starting medium with a separate actuation handle makes it possible to meter in the desired amount of the second starting medium after the dosing chamber has been filled with the first starting medium.

The feed mechanism can comprise a feed pump having an inlet with inlet valve and having an outlet with outlet valve. The inlet of the feed pump can be connected to a second reservoir for the second starting medium. The outlet of the feed pump can be connected to the second inlet of the dosing chamber.

In this configuration, the feed mechanism for feeding the second starting medium is designed as a pump which sucks medium from a second reservoir and, through its outlet, allows the second starting medium to be fed into the dosing chamber.

Alternatively, the feed mechanism can have a piston which is displaceable in one direction in a feed cylinder, and which is displaceable in steps by means of the auxiliary actuation handle. Here, a sawtooth coupling can preferably be provided between the auxiliary actuation handle and the piston, which sawtooth coupling enforces a movement of the piston upon actuation of the auxiliary actuation handle and permits an increase in the distance of the piston from the auxiliary actuation handle when the actuation handle is reset.

In this alternative variant of a feed mechanism, no separate reservoir is provided. Instead, a piston is moved in steps and, with each advance, a volume of the second starting medium is fed into the dosing chamber. In the state when delivered, the piston contains the entire amount of the second starting medium. It can be moved only one step further with each actuation of the auxiliary actuation handle and, for repeated dispensing of the second starting medium into the dosing chamber, a return stroke of the auxiliary actuation handle is needed after every stroke movement.

In a design suitable for this purpose, provision is made that the auxiliary actuation handle and the piston can likewise be moved relative to each other in one direction. The stated sawtooth coupling is a suitable design for this purpose. When the auxiliary actuation handle is pressed down, the sawtooth coupling leads to a joint movement with the piston. By means of an underpressure and/or force-fit engagement or form-fit engagement between piston and feed cylinder, the sawtooth coupling jumps forward during the return stroke of the auxiliary actuation handle, such that, upon repeated actuation of the auxiliary actuation handle, the start point of the piston in each case corresponds to the end position in the preceding stroke.

The design of a feed mechanism with an actuation handle and with a piston, which are connected to each other in a known manner by a sawtooth coupling, is an expedient design not only in the area of the described discharge head, it could also be expediently used in isolation in other types of dispensers, for example drop dispensers.

The feed mechanism can be designed to introduce a defined amount V of the second starting medium upon a single actuation of the auxiliary actuation handle. The outlet of the dosing chamber is assigned an outlet valve that opens in a pressure-dependent manner. This outlet valve, the feed mechanism for introducing the second starting medium, and the volume-compensating mechanism can be coordinated in such a way that the volume-compensating mechanism can accept at least the amount V of the second starting medium without the outlet valve thereby being opened, preferably at least the amount 3×V, particularly preferably the amount 6×V.

The stated coordination ensures that at least one but preferably several amounts V of the second starting medium dispensed into the dosing chamber can be received by actuation of the auxiliary actuation handle, without liquid thereby already flowing out through the outlet of the dosing chamber. For this purpose, it is necessary in particular to coordinate the pressures that are needed to move the wall portion of the volume-compensating unit on the one hand and for opening the outlet valve. The pressure required for moving the wall portion should be less than that for opening the outlet valve, until the deflectable wall portion adopts its maximal position.

The deflectable dosing-chamber wall portion of the volume-compensating mechanism can be provided on the displacer. The displacer can be rigidly connected to a discharge actuation handle.

It is often structurally easier to arrange the volume-compensating unit and in particular the deflectable wall portion on the displacer than on the base. The displacer preferably directly constitutes the actuation handle. However, embodiments are also conceivable in which a gear is provided between the displacer and the actuation handle.

The deflectable dosing-chamber wall portion can be provided on the discharge actuation handle in such a way that it is forced in the direction of its maximal position or in the direction of its minimal position by actuation of the discharge actuation handle.

The arrangement of the dosing-chamber wall portion such that it adopts its maximal position or its minimal position upon an actuation serves to calculate the amount of liquid that is to be discharged. During the intended use of a discharge head, at the start of the discharge operation the dosing-chamber wall portion is not always in the same position, depending on the previously added second starting medium. However, it is advantageous if, in the second end position of the displacer relative to the base, there is a defined position of the deflectable dosing chamber wall portion. The remaining dead volume is thus constant.

The deflectable dosing-chamber wall portion can be arranged in the dosing chamber in such a way that it is forced in the direction of its maximal position or in the direction of its minimal position in the course of the actuation of the discharge actuation handle. The deflectable dosing-chamber wall portion formed by a dimensionally flexible wall can preferably be configured in such a way that, when subjected to force, it can be deflected transversely with respect to the direction of actuation, and a portion in the dosing chamber is provided which cooperates with the deflectable dosing-chamber wall and by which the deflectable dosing-chamber wall is deflected upon movement of the displacer.

In this design, it is the cooperation of the deflectable dosing-chamber wall portion with a portion of the dosing chamber that brings about the defined position of the dosing-chamber wall portion during the movement of the displacer relative to the base. Thus, in an arrangement of the deflectable dosing-chamber wall portion on the displacer, provision can be made that the latter is subjected to force by a dosing-chamber portion of the base and brought to a defined position during the movement.

The deflectable dosing-chamber wall portion can be provided on the discharge actuation handle in the area of a finger support surface.

This is a particularly simple way of ensuring a defined position of the dosing-chamber wall portion during the actuation of the discharge actuation handle. By virtue of the fact that this portion is provided directly in the area of a finger support surface, it is pressed automatically in the direction of its minimal position when the discharge actuation handle is pressed down. The arrangement of the deflectable dosing-chamber wall portion on the finger support surface additionally has the advantage of making it possible to ascertain by touch whether the second starting medium, and if so how much of it, has already been supplied.

The invention further relates to a dispenser for mixing two starting media and for discharging the mixed liquid that is thereby generated. The dispenser has a first reservoir and a second reservoir for receiving the two starting media. It moreover has a discharge head of the type described above.

In addition to the described discharge head, such a dispenser thus also has separately stored starting media. As has already been described, these starting media can be sucked through a dip tube or can be stored in ventilation-free reservoirs with trailer pistons or a flexible bag. A preferred area of use is that of cosmetic lotions, in which case the first starting medium forms the basis of this lotion, while the second starting medium can be an auxiliary active substance.

Further advantages and aspects of the invention will become clear from the claims and from the following description of preferred illustrative embodiments of the invention, which are explained below with reference to the figures.

DETAILED DESCRIPTION OF THE ILLUSTRATIVE EMBODIMENTS

Figure 1:
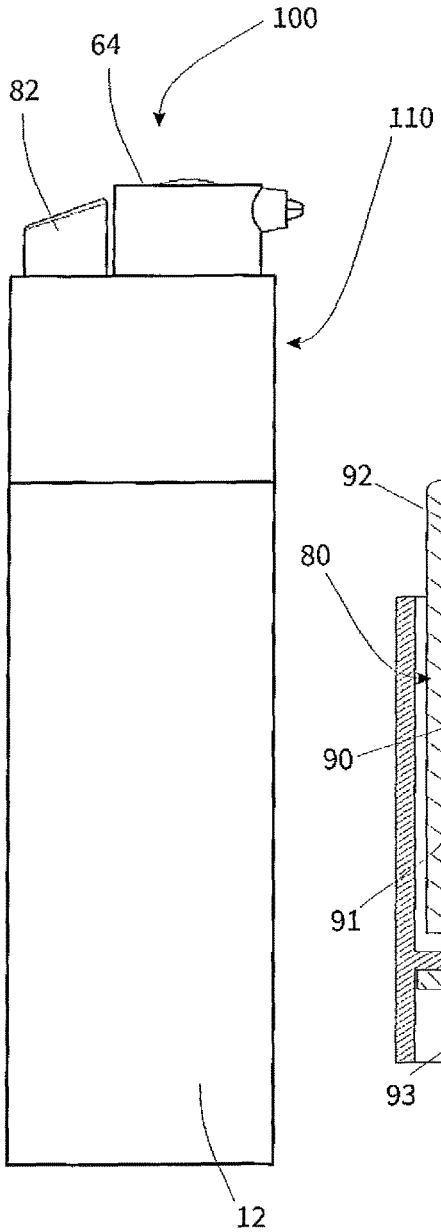
FIG. 1 and FIG. 2 show a first embodiment of the invention.
Figure 2:
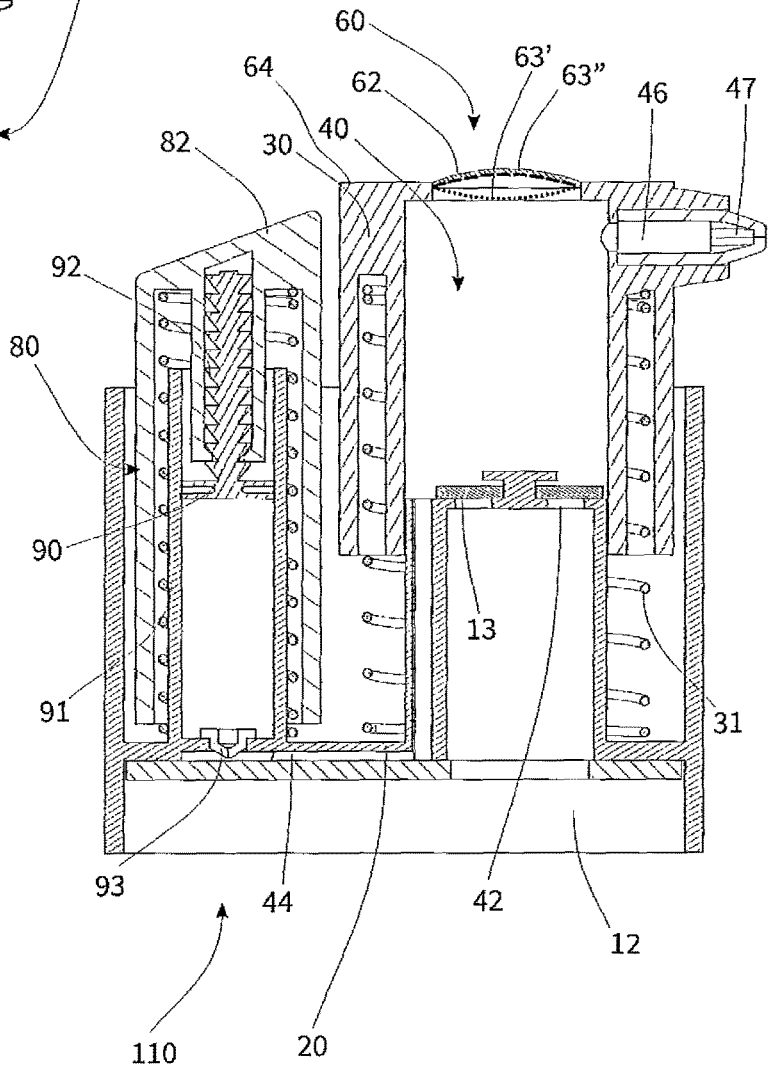

FIGS. 1 and 2 show a first embodiment of the invention. FIG. 1 shows the dispenser 100 as a whole, with a discharge head 110 mounted on a reservoir 12 for a first starting medium. The discharge head 110 has a discharge actuation handle 64 and an auxiliary actuation handle 82.

The dispenser 100 of FIG. 1 is intended for use in a procedure in which a dosing chamber 40 shown in FIG. 2, and described further below, is first of all filled with the first starting medium from the reservoir 12 from a preceding discharge operation.

Proceeding from this starting situation, the auxiliary actuation handle 82 can be used to meter in a desired amount of a second starting medium. When this metering is completed, the mixture composed of both starting media can be discharged through an outlet with outlet valve 47 by depressing the discharge actuation handle 64.

FIG. 2 shows the structure of the discharge head 110 in detail. The latter has a base 20, which is mounted rigidly on the housing body that encloses the reservoir 12. A one-piece configuration is also possible. A displacer 30 is movable relative to the base 20, said displacer 30 being forced by means of a restoring spring 31 permanently into the first end position of FIG. 2. The base 20 and the displacer 30 together enclose the aforementioned dosing chamber 40. This dosing chamber is supplied through two inlets 42, 44.

The first inlet 42 connects the dosing chamber 40 to the reservoir 12, it preferably being possible here (in a manner not shown) for a dip tube to be additionally provided which protrudes into the reservoir 12. This first inlet 42 is closed by means of a valve plate 13 when there is an overpressure in the dosing chamber 40.

The second inlet 44 leads to a separate feed mechanism 80. This separate feed mechanism has a piston 90, which is arranged inside a cylinder 91, wherein this cylinder 91, in the state when delivered, contains the second starting medium. The cylinder 91 is connected to the inlet 44 of the dosing chamber 40 via a valve 93, which opens when there is an overpressure in the cylinder 91. An auxiliary actuation handle 82 is provided for moving the piston 90. The auxiliary actuation handle 82 and the piston 90 are not designed in one piece but in two pieces and are connected to each other by a sawtooth coupling 92, the function of which is explained in detail below.

When, after a preceding discharge operation, the displacer 30, driven by the spring 31, returns from its second, lower end position to the first end position of FIG. 2, with the inlet valve 13 open, it sucks the first starting medium out of the reservoir 12 into the dosing chamber 40, such that the dosing chamber is completely filled with the first starting medium when the first, upper end position is reached. The inlet valve 13 already opens at a lower underpressure than the outlet valve 93, such that no inward flow of second starting medium has taken place up to this point.

A volume-compensating mechanism 60, provided on the top of the displacer 30 in the area of the actuation handle 64, has a membrane 62 which is movable between a minimal position 63' and a maximal position 63". By means of the underpressure during the described return stroke, this membrane 62 adopts its minimal position 63' when the first starting medium is sucked in.

If the auxiliary actuation handle 82 is now pressed down when the dosing chamber 40 is filled with the first starting medium, the piston 90 is thereby also pressed down and a volume V from the cylinder 91 is fed through the outlet valve 93 likewise to the dosing chamber 40. To ensure that at this time there is no unwanted discharge of liquid through the outlet channel 46 and the outlet valve 47, the volume-compensating mechanism allows this additional volume V to be received in the dosing chamber 40 by movement of the membrane 62 in the direction of its maximal position 63". A mixture composed of the two starting media is now present in the dosing chamber 40.

During the return stroke of the auxiliary actuation handle 82, the piston 90 remains at its previously attained position, since its bears with force-fit engagement on the inner walls of the cylinder 91 and, in addition, the now closed outlet valve 93 causes the formation of an underpressure when the piston 90 is subjected to force in an upward direction. The piston 90 is therefore no longer moved upward, and instead the sawtooth coupling 92 between the auxiliary actuation handle 82 and the piston 90 jumps one tooth onwards. Thus, after the return stroke of the auxiliary actuation handle 82, a further volume V can be fed from the cylinder 91 to the dosing chamber 40 by pressing the auxiliary actuation handle 82 down again. The membrane 62 and its mobility are preferably such that at least the volume V, but preferably a volume of 3×V or more, can be fed to the dosing chamber 40 without the outlet valve 47 opening.

When the desired amount of the second starting medium has been fed from the cylinder 91 into the dosing chamber 40, it is possible, by pressing down the actuation handle 64 and displacer 30, to discharge the volume from the dosing chamber 40 through the outlet 46. Since the corresponding manual force is applied in the area of the membrane 62, the latter is automatically pressed in the direction of its minimal position 63'. The volume remaining in the dosing chamber 40, when the displacer 30 has been pressed to its lower, second end position, is therefore substantially constant. When the discharge actuation handle 64 is released, the cycle begins anew.

Figure 3:
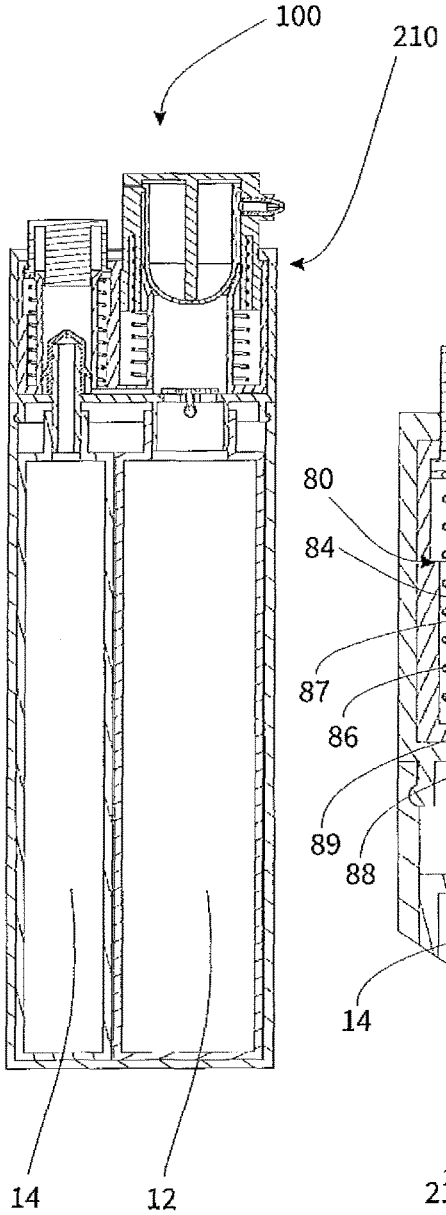
FIG. 3 and FIG. 4 show a first embodiment of the invention.
Figure 4:
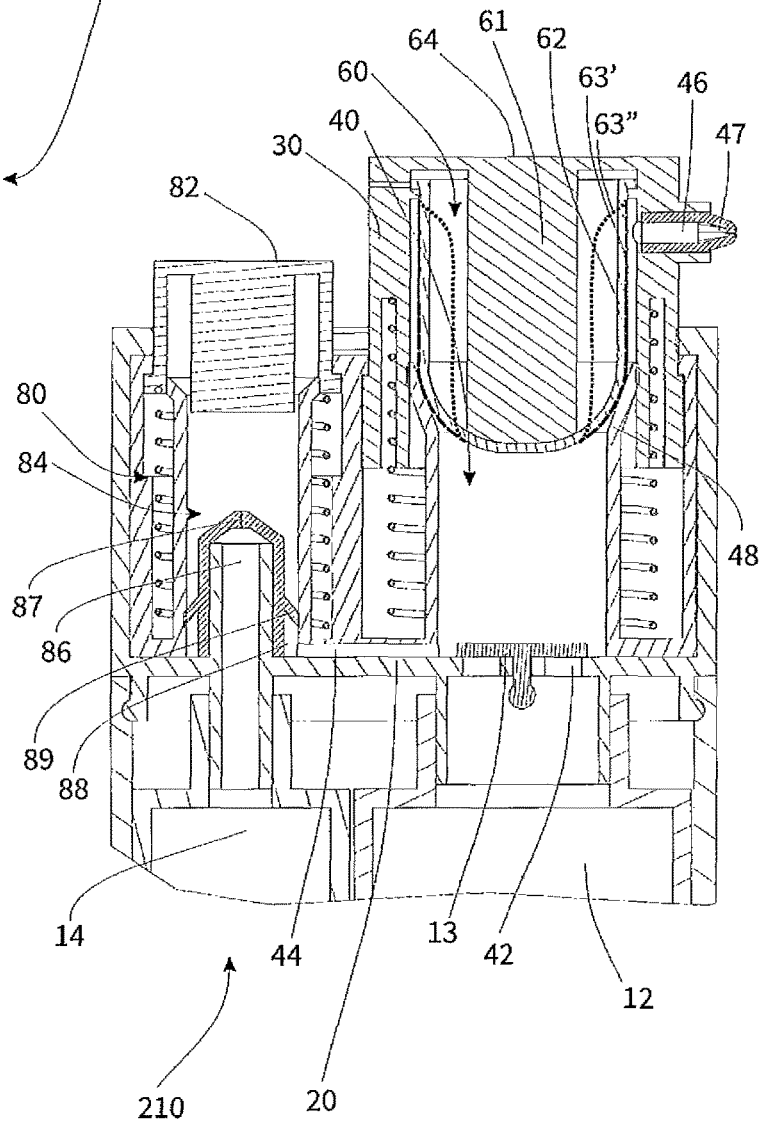

The embodiment in FIGS. 3 and 4 is an alternative embodiment, which differs from the embodiment in FIGS. 1 and 2 particularly in two respects.

The first difference concerns the auxiliary feed mechanism 80. The latter is designed as a reciprocating pump in the embodiment in FIGS. 3 and 4. Therefore, a separate reservoir 14 is provided which, in the manner shown in FIG. 3, is arranged next to the reservoir 12 for the first starting medium. This reservoir 14 is connected to a pump chamber of the auxiliary feed mechanism 80 via an inlet channel 86 and a valve 87 that opens in a pressure-dependent manner. An outlet channel 88 and an outlet valve 89, likewise opening in a pressure-dependent manner, are again provided on the output side. By way of the auxiliary actuation handle 82, this pump can be actuated such that the second starting medium is fed from the reservoir 14 into the pump chamber 40.

The second main difference is that the volume-compensating mechanism 60 provides a much greater compensation volume. For this purpose, a pin 61 protruding into the pump chamber 40 is provided on the displaces 30 and supports a peripheral membrane 62 surrounding the pin 61. The maximal position and minimal position indicated by the lines 63', 63" illustrate how a comparatively large amount of liquid can be introduced by means of the auxiliary feed mechanism 80 into the pump chamber 40 already filled with the first starting medium, without the medium already being discharged through the outlet 46 and the outlet valve 47. If the actuation handle is pressed down after the dosing chamber 40 is filled with the first starting medium and one or more charges of the second starting medium, the tapering 48 of the dosing chamber 40 has the effect that the membrane 62 is moved to its maximal position 63". Independently of the amount of the second starting medium that is fed into the pump chamber 40, there is therefore a defined dead volume of the pump chamber 40 when the actuation handle 64 and the displacer 30 are pressed down relative to the base 20.

The invention claimed is:

1. A discharge head for mixing two starting media and for discharging a mixed liquid that is thereby generated, comprising:

a dosing chamber which is delimited by dosing-chamber walls, the dosing-chamber walls being provided on a base of the discharge head and on a displacer of the discharge head;

a first inlet, through which a first of the two starting media can flow into the dosing chamber;

a second inlet, through which a second of the two starting media can flow into the dosing chamber; and an outlet through which the mixed liquid can be discharged from the dosing chamber;

the displacer being manually movable relative to the base in an actuation direction between a first end position and a second end position, such that, during movement of the displacer from the first end position to the second end position, a volume of the dosing chamber is reduced and the mixed liquid is forced out through the outlet;

the dosing chamber has a volume-compensating mechanism;

the volume-compensating mechanism having a deflectable dosing-chamber wall portion which delimits the dosing chamber and which is deflectable, with respect to the first end position of the displacer relative to the base, between a minimal position, in which the deflectable dosing-chamber wall portion does not enlarge the volume of the dosing chamber, and a maximal position, in which the deflectable dosing-chamber wall portion enlarges the volume of the dosing chamber to a maximum extent; and by virtue of the deflection of the deflectable dosing-chamber wall portion in the direction of the maximal position, an auxiliary volume is made available in the dosing chamber through which, with the dosing chamber already filled with the first of the two starting media, the second of the two starting media can still be introduced into the dosing chamber.

2. The discharge head according to claim 1, wherein:

the deflectable dosing-chamber wall portion is formed by a dimensionally flexible wall; or the deflectable dosing-chamber wall portion is formed by an inherently rigid, displaceable wall portion.

3. The discharge head according to claim 1, wherein:

in order to introduce the first of the two starting media into the dosing chamber, the dosing chamber is connected to a first reservoir for the first of the two starting media; and a valve that opens in a pressure-dependent manner is provided between the first reservoir and the dosing chamber.

4. The discharge head according to claim 1, wherein:

in order to introduce the second of the two starting media into the dosing chamber, a feed mechanism is provided that can be actuated by an auxiliary actuation handle.

5. The discharge head according to claim 4, wherein:

the feed mechanism has a feed pump having an inlet with an inlet valve and having an outlet with an outlet valve;

the inlet of the feed pump is connected to a second reservoir for the second of the two starting media; and the outlet of the feed pump is connected to the second inlet of the dosing chamber.

6. The discharge head according to claim 4, wherein:

the feed mechanism has a piston which is displaceable in one direction in a feed cylinder, and which is displaceable in steps by the auxiliary actuation handle; and a sawtooth coupling is provided between the auxiliary actuation handle and the piston, the sawtooth coupling enforcing a movement of the piston upon actuation of the auxiliary actuation handle and permitting an increase in a distance of the piston from the auxiliary actuation handle when the actuation handle is reset.

7. The discharge head according to claim 4, wherein:

the feed mechanism introduces a defined amount V of the second of the two starting media upon a single actuation of the auxiliary actuation handle;

the outlet of the dosing chamber is assigned an outlet valve that opens in a pressure-dependent manner; and the feed mechanism for introduces the second of the two starting media, the volume-compensating mechanism and the outlet valve of the dosing chamber are coordinated in such a way that the volume-compensating mechanism can accept at least the amount V of the second of the two starting media without the outlet valve thereby being opened.

8. The discharge head according to claim 1, wherein:

the deflectable dosing-chamber wall portion of the volume-compensating mechanism is provided on the displaces; and the displacer is rigidly connected to a discharge actuation handle.

9. The discharge head according to claim 8, wherein:

the deflectable dosing-chamber wall portion is provided on the discharge actuation handle in such a way that the deflectable dosing-chamber wall portion is forced in the direction of a maximal position thereof or in the direction of a minimal position thereof by actuation of the discharge actuation handle.

10. The discharge head according to claim 1, wherein:

the deflectable dosing-chamber wall portion is arranged in the dosing chamber in such a way that the deflectable dosing-chamber wall portion is forced in the direction of a maximal position thereof or in the direction of a minimal position thereof during actuation of a discharge actuation handle;

the deflectable dosing-chamber wall portion formed by a dimensionally flexible wall is configured in such a way that, when subjected to force, the deflectable dosing-chamber wall portion can be deflected transversely with respect to a direction of actuation; and a portion in the dosing chamber is provided which cooperates with the deflectable dosing-chamber wall portion and by which the deflectable dosing-chamber wall is deflected upon movement of the displacer.

11. The discharge head according to claim 1, wherein:

the deflectable dosing-chamber wall portion is provided on a discharge actuation handle in an area of a finger support surface; or the deflectable dosing-chamber wall portion is provided as a dimensionally flexible wall on the displacer or on the base, wherein the respective structural part is produced by two-component injection moulding; or a feed mechanism has a restoring spring mechanism which is assigned to an auxiliary actuation handle.

12. A dispenser for mixing two starting media and for discharging the mixed liquid that is thereby generated, comprising:

a first reservoir and a second reservoir for receiving the two starting media; and a discharge head according to claim 1.

13. The dispenser according to claim 12, wherein:

the first reservoir is filled with a skin cream.

14. The discharge head according to claim 2, wherein:

the inherently rigid, displaceable wall portion is in a compensation piston which is arranged displaceably in a compensation cylinder of the dosing chamber.

15. The discharge head according to claim 7, wherein:

the feed mechanism for introducing the second of the two starting media, the volume-compensating mechanism and the outlet valve of the dosing chamber are coordinated in such a way that the volume-compensating mechanism can accept at least 3 times the amount V of the second of the two starting media without the outlet valve thereby being opened.

16. The discharge head according to claim 7, wherein:

the feed mechanism for introducing the second of the two starting media, the volume-compensating mechanism and the outlet valve of the dosing chamber are coordinated in such a way that the volume-compensating mechanism can accept at least 6 times the amount V of the second of the two starting media without the outlet valve thereby being opened.

17. The discharge head according to claim 11, wherein:

the restoring spring mechanism is an integral part of the auxiliary actuation handle.

18. A discharge head for mixing two starting media and for discharging a mixed liquid that is thereby generated, comprising:

a base having base walls;

a displacable member having displacable member walls;

a dosing chamber defined by the base walls and the displacable member walls;

a first inlet through which a first of the two starting media can flow into the dosing chamber;

a second inlet through which a second of the two starting media can flow into the dosing chamber; and an outlet through which the mixed liquid can be discharged from the dosing chamber;

the displacable member being manually movable relative to the base in an actuation direction between a first end position and a second end position, such that, during movement of the displacable member from the first end position to the second end position, a volume of the dosing chamber is reduced and the mixed liquid is forced out through the outlet;

a volume-compensating mechanism having a deflectable dosing-chamber wall portion that further defines the dosing chamber;

the deflectable dosing-chamber wall portion being deflectable with respect to the displacable member when the displacable member is in the first end position between a minimal position, in which the deflectable dosing-chamber wall portion does not enlarge the volume of the dosing chamber, and a maximal position, in which the deflectable dosing-chamber wall portion enlarges the volume of the dosing chamber to a maximum extent; and by virtue of the deflection of the deflectable dosing-chamber wall portion in the direction of the maximal position, an auxiliary volume is made available in the dosing chamber through which, with the dosing chamber already filled with the first of the two starting media, the second of the two starting media can be introduced into the dosing chamber.

19. The discharge head according to claim 18, wherein:

in order to introduce the first of the two starting media into the dosing chamber, the dosing chamber is connected to a first reservoir for the first of the two starting media; and a valve that opens in a pressure-dependent manner is provided between the first reservoir and the dosing chamber.

20. The discharge head according to claim 19, wherein: in order to introduce the second of the two starting media into the dosing chamber, a feed mechanism is provided that can be actuated by an auxiliary actuation handle of the discharge head.

* * * * *